US007482994B2

(12) United States Patent
Wen et al.

(10) Patent No.: US 7,482,994 B2
(45) Date of Patent: Jan. 27, 2009

(54) THREE-DIMENSIONAL H-FRACTAL BANDGAP MATERIALS AND ANTENNAS

(75) Inventors: Weijia Wen, Kowloon (HK); Ping Sheng, Kowloon (HK); Bo Hou, Kowloon (HK)

(73) Assignee: The Hong Kong University of Science and Technology, Hong Kong SAR (CN)

( * ) Notice: Subject to any disclaimer, the term of this patent is extended or adjusted under 35 U.S.C. 154(b) by 224 days.

(21) Appl. No.: 11/398,474

(22) Filed: Apr. 5, 2006

(65) Prior Publication Data

US 2007/0236406 A1 Oct. 11, 2007

(51) Int. Cl.
*H01Q 15/02* (2006.01)

(52) U.S. Cl. ..... 343/909; 343/700 MS

(58) Field of Classification Search ..... 343/909, 343/700 MS

See application file for complete search history.

(56) References Cited

U.S. PATENT DOCUMENTS 6,104,349 A 8/2000 Cohen ..... 343/702
6,127,977 A 10/2000 Cohen ..... 343/700
6,140,975 A 10/2000 Cohen ..... 343/846
6,300,914 B1 * 10/2001 Yang ..... 343/741
6,552,690 B2 * 4/2003 Veerasamy ..... 343/713
6,710,744 B2 * 3/2004 Morris et al. ..... 343/700 MS
6,727,863 B2 4/2004 Wen et al. ..... 343/909
2007/0067058 A1 * 3/2007 Miyamoto et al. ..... 700/120
2007/0100385 A1 * 5/2007 Rawat et al. ..... 607/37

* cited by examiner

*Primary Examiner*—Tho G Phan
(74) *Attorney, Agent, or Firm*—Heslin Rothenberg Farley & Mesiti P.C.

(57) ABSTRACT

A three dimensional (3D) fractal structure with H as the mother element is hereby disclosed. Such a 3D structure can act as selective total microwave reflectors or selective microwave filters in transmission. When excited through current injection, such a 3D fractal structure can act as highly efficient antenna for radiating or detecting pre-determined microwaves, with the relevant wavelength much larger than the size of the radiation or detection structure.

22 Claims, 10 Drawing Sheets

THREE-DIMENSIONAL H-FRACTAL BANDGAP MATERIALS AND ANTENNAS

FIELD OF THE INVENTION

This invention relates to novel three-dimensional (3D) bandgap composite materials having band gap properties, and in particular to such materials in which at least one of the components is formed with 3D H-fractal configurations. The invention also relates to antennas formed by similar three-dimensional fractal structures.

BACKGROUND OF THE INVENTION

Photonic band gap (PBG) materials are those periodic composites that possess spectral gaps in the frequency spectrum, in which electromagnetic waves cannot propagate in any direction within the material. Conventional photonic band gap materials are based on Bragg scattering. The Bragg scattering mechanism imposes several constraints on the realization of PBG and its application because it requires periodicity and long range order, and the overall dimension of the PBG crystal must be at least a few times the wavelength at the spectral gap. This latter limitation in particular makes such conventional PBG materials unsuitable for use at, for example, radio frequencies because the material sample would have to be very large for the dimensions to be comparable with the wavelength of the radiation. Such limitations make these PBG structures too bulky and difficult to fabricate for lower frequency applications.

Another bandgap material that can be artificially constructed is based on so-called local resonances. Resonances can also create classical wave band gaps. For example, the interaction of EM waves with the electron gas in metals (plasmon) and the optical phonons in ionic crystals (polariton) can create spectral gaps in which EM waves cannot propagate.

In the field of mathematics, fractal patterns have proven to be useful tools in the analysis of mathematically complex and chaotic patterns. They have yet, however, to find widespread practical applications in physical sciences. Fractal patterns may be applied in the field of antennas as follows, for example: a microstrip patch antenna formed with a fractal structure on at least one surface of a substrate; or an antenna structure with a fractal ground counterpoise and a fractal antenna structure. It is also possible to tune fractal antennas and fractal resonators.

Also, metallic fractal configurations on a dielectric plate can be used for generating multiple stop and pass bands, while its inverse pattern can have the reverse characteristics. Such planar resonating structures employing two-dimensional periodically arranged arrays of metallic elements may be etched on dielectric plates. They are frequently used as filtering devices, denoted frequency selective surfaces (FSS) in the engineering community. For the fractal plate, there are a multitude of internal resonances. The fractal plate behaves like a system with negative dielectric constant in the vicinities of resonance frequencies, and thus possesses a series of spectral gaps for the incident wave.

SUMMARY OF THE INVENTION

According to the invention there is provided a three-dimensional (3D) bandgap material comprising a three-dimensional fractal structure, tuned to define at least one predetermined transmission bandgap.

In preferred embodiments of the invention the fractal structure is formed of a conductive material. In such embodiments the conductive fractal structure may be embedded in a dielectric material. Alternatively the fractal structure is formed by a dielectric material embedded in a conductive material.

Preferably the fractal structure is formed with between 2 to 15 levels.

Preferably the fractal structure is formed by subjecting a mother element to a repeated affine transformation through the whole three dimensions, with the rule that each line segment be perpendicular to the plane formed by the two lower-level lines. The mother element is preferably an H-shape and the transformation comprises scaling.

In preferred embodiments of the invention the low-frequency limit of the bandgap(s) possessed by the material is determined by the number of levels of the fractal pattern, and/or the length of lowest-level line.

Preferably the invention provides a conducting three-dimensional H-fractal pattern formed with at least one bandgap at a wavelength that is larger than all the dimensions of the said material. Alternatively the fractal structure is defined by dielectric materials forming a 3D H-fractal pattern embedded in a conducting material which has at least one bandgap at a wavelength that is larger than all the dimensions of the said material. When the fractal structure is conductive a further possibility is that means for injecting current into the fractal structure may be provided.

Preferably also at least one capacitive or inductive element is included in said fractal structure.

According to another aspect of the invention there is provided a method of forming a bandgap composite material comprising the step of forming a 3D H-fractal structure with a mother element whose dimensions and number of levels are selected to define at least one predetermined bandgap for the composite material. Preferably the fractal structure is formed of conductive material and means for injecting a current into the fractal structure are provided to thereby alter the electromagnetic properties of said composite material.

According to a still further aspect of the invention there is provided A three-dimensional fractal antenna comprising a three-dimensional conductive fractal structure.

The fractal structure may be formed of a metal, and which may be embedded in a dielectric material. Preferably the fractal structure is formed with between 2 to 15 levels.

Preferably the fractal structure is formed by subjecting a mother element to a repeated affine transformation through the whole three dimensions, with the rule that each line segment be perpendicular to the plane formed by the two lower-level lines. Preferably the mother element is an H-shape and said transformation comprises scaling.

Means may be provided for injecting a current to form a 3D radiating antenna with a radiated wavelength larger than all the linear dimensions of the antenna.

A capacitive or inductive element may be inserted in the fractal structure.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

As will be apparent from the descriptions of several embodiments of the present invention, the present invention is based on a generalization of the H-fractal to three dimensional (3D) space, wherein the metal "H" lines are repeated to form a 3D fractal bandgap materials in which the lowest wavelength of stop-bands (pass-bands) can be even longer than that of a two dimensional (2D) fractal plate. Therefore, such 3D fractal bandgap materials can be considered as superior sub-wavelength bandgap metamaterials.

A potential application of the 3D H-fractal composite is the area of antennas for EM wave radiation or detection. An important issue for the antenna is its radiation wavelength versus radiation efficiency. In general, efficient antenna radiation requires the size (length) of the antenna to be comparable with the radiation wavelength. Thus longer radiation wavelength would require larger-sized antenna. The strong relationship between the behavior of an antenna and its size relative to the operating wavelength has always imposed a tight constraint on the antenna design. However as will be seen from the following the use of a 3D H-fractal composite may offer some characteristics that can be exploited to relax this constraint. Embodiments of the invention may comprise a three-dimensional fractal consisting of H-fractal metallic wire elements, either in air or embedded in a dielectric environment. Also impossible is the inverted structure wherein the metallic fractal is substituted with dielectric materials and embedded in metal. For the metallic fractal configuration, multiple stop and pass bands can be obtained for the incident EM wave, while the inverted structure possesses the complementary characteristics. The underlying physics for the 3D H-fractal is similar to its 2D counterpart. That is, both possess localized, sub-wavelength resonances.

Furthermore by injecting high-frequency current into the 3D H-fractal, microwave radiation can be obtained at frequencies much lower than with conventional dipole or planar H-fractal antennas. Thus the 3D structure of the present invention can be used for constructing so-called sub-wavelength antennas with high efficiency. The radiating frequency can be further lowered when the metallic 3D fractal is embedded in a high dielectric constant material.

Figure 1:
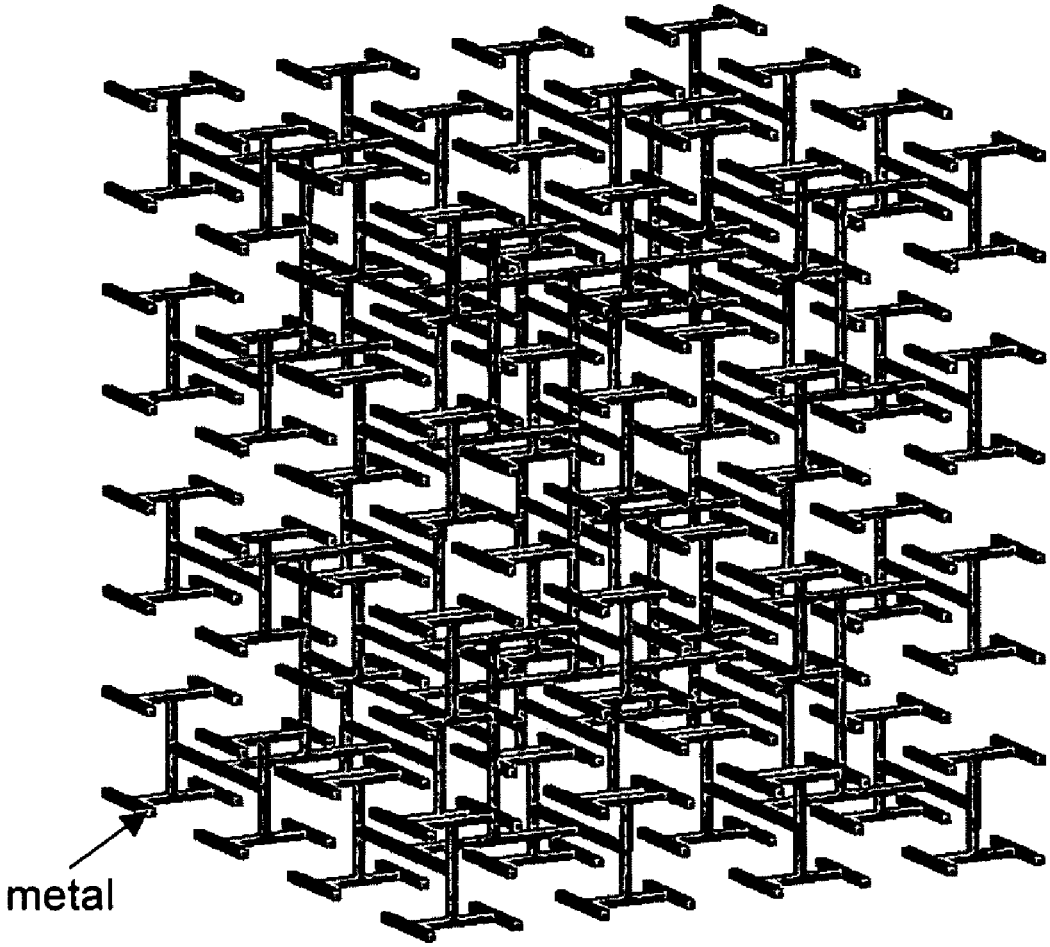
FIG. 1 shows a three-dimensional 9-level H-shaped fractal structure.
Figure 2:
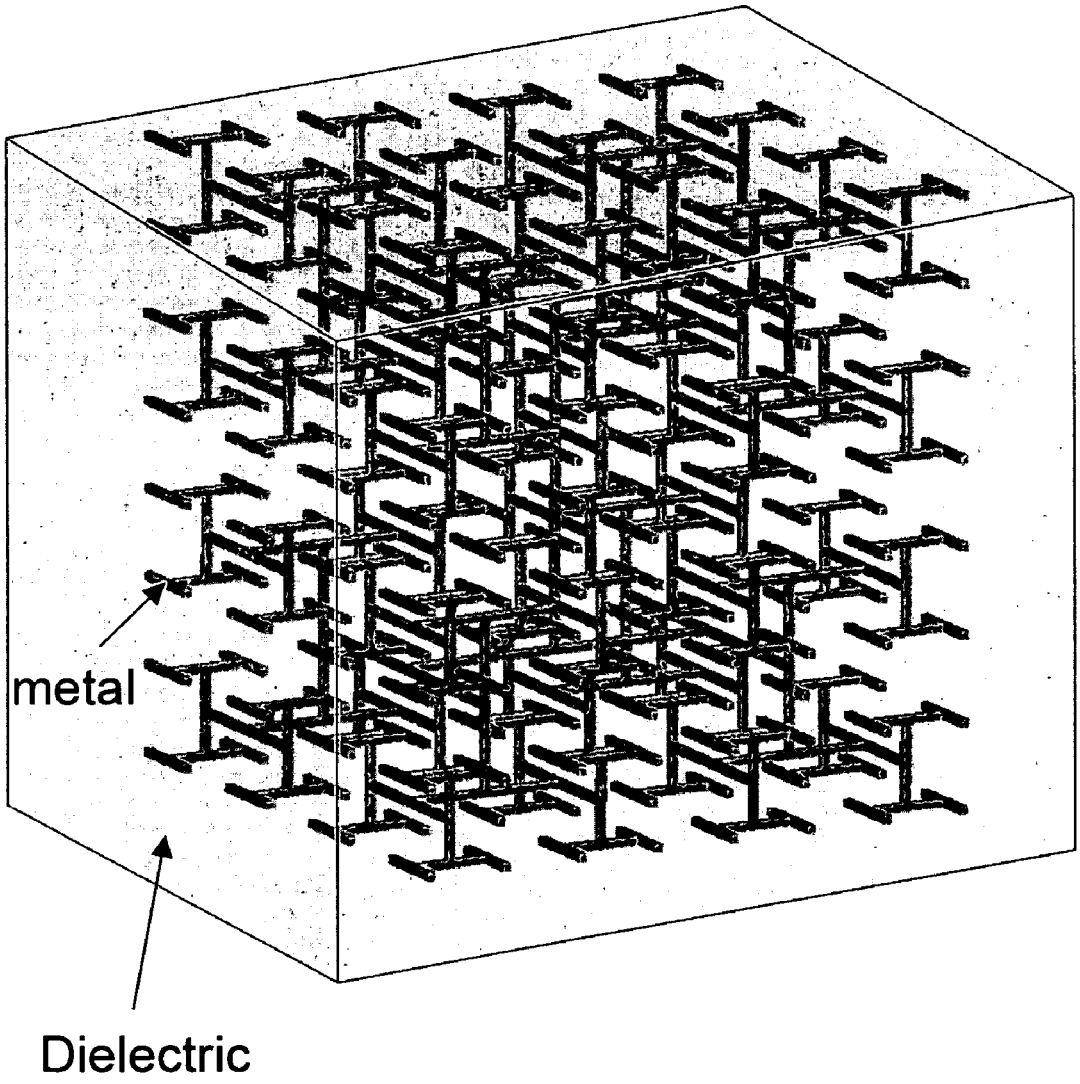
FIG. 2 shows a three-dimensional 9-level metallic H-fractal embedded in a dielectric medium.

FIG. 1 shows a three-dimensional H-fractal design for use in an embodiment of the invention. The structure of FIG. 1 is a three-dimensional metallic fractal with a mother element H, constructed to 9 levels. The wire may be any suitable conducting material. The basic construction principle is similar to the planar H-fractal described in U.S. Pat. No. 6,727,863 except that each new line element is always perpendicular to the plane formed by the two previous lower-level lines. The structure of FIG. 1 can be embedded in a dielectric material as shown in FIG. 2. The inverted version of the structure of FIG. 2 is to form the 3D fractal structure of a dielectric material and then to embed the dielectric fractal in a metallic or conducting material. However, the embodiments discussed below are in respect of a metallic fractal structure embedded in a dielectric.

It will be understood that the number of levels of the fractal structure may be varied upon the desired characteristics of the resulting bandgap material, but typically the structure may have from 2 to 15 levels. The size of the mother element may likewise be varied but typical dimensions may be a few centimeters, e.g. about 2 cm or 2.5 cm.

Figure 3:
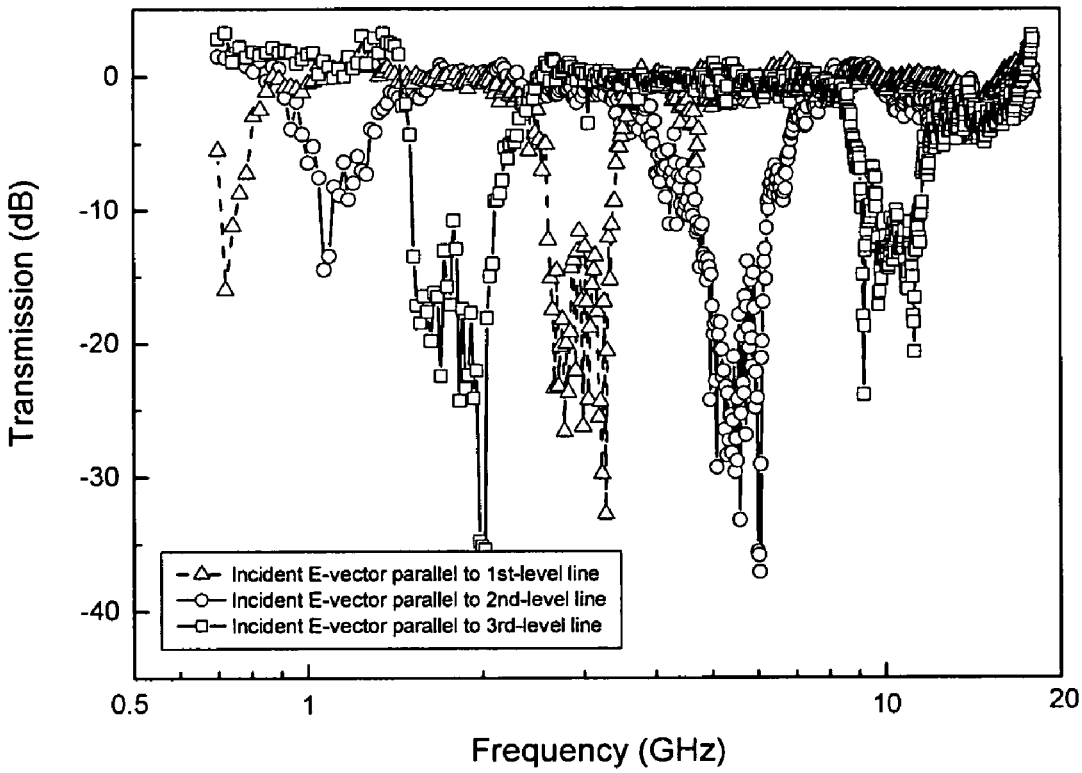
FIG. 3 shows the transmission of a 3D 6-level metal fractal at different incident polarizations.

FIG. 3 shows the transmission characteristics of a 3D 6-level fractal measured at different incident polarizations of the EM wave. For the experiment, 49 such 6-level fractal structures, each measuring 4×4×4 $cm^3$, were arranged into a 7×7 array. In each fractal unit the master line has a length of 2.5 cm and is formed of conducting wire 1 mm in diameter. Two identical microwave horns (HP11966E) were used to generate and receive the signals separated by a distance of 100 cm. The sample was placed on a stage, 15 cm from the receiving horn. The microwave spectra were measured by a network analyzer (Agilent 8720ES). All measured spectra were normalized to the transmission when no sample is mounted. Three different faces of the 3D fractal structure were illuminated with both vertical- and horizontal-polarized EM wave, and a total of 6 stop bands were observed in the measured frequency range (700 MHz-18 GHz), shown in FIG. 3, where the lowest band is located at 0.72 GHz.

Figure 4:
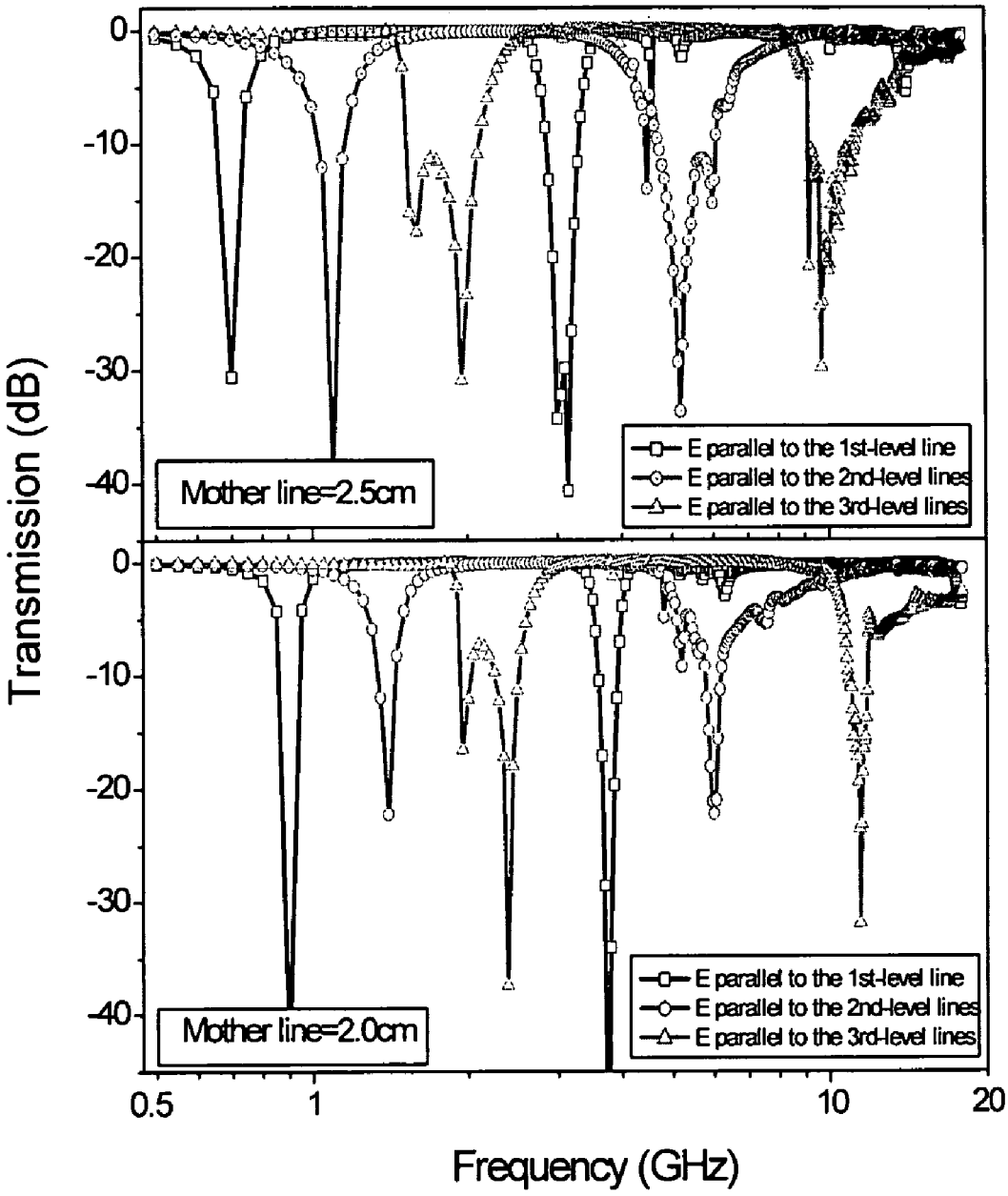
FIG. 4 shows the transmission as a function of frequency for different sized mother elements, FIG. 5(*a*) shows the measured return loss (the so-called $S_{11}$) characteristics of a 3D 6-level fractal, a 2D 4-level fractal and a dipole, (*b*) shows the simulated return loss of the 3D 6-level fractal and the dipole, where the 3D fractal antenna is fed by a input source of impedance 5Ω, while the dipole is fed by a 50Ω input source.

FIG. 4 shows how the length of the mother element can be adjusted to vary the electrical properties of the fractal. The top half of FIG. 4 shows the transmission with a 2.5 cm mother element and the bottom half shows the transmission with a 2 cm mother element. In both cases incident waves with three different directions to the fractal are plotted. It can be seen that the stop-bands shift to lower frequencies as the length of the mother element increases.

Figure 5:
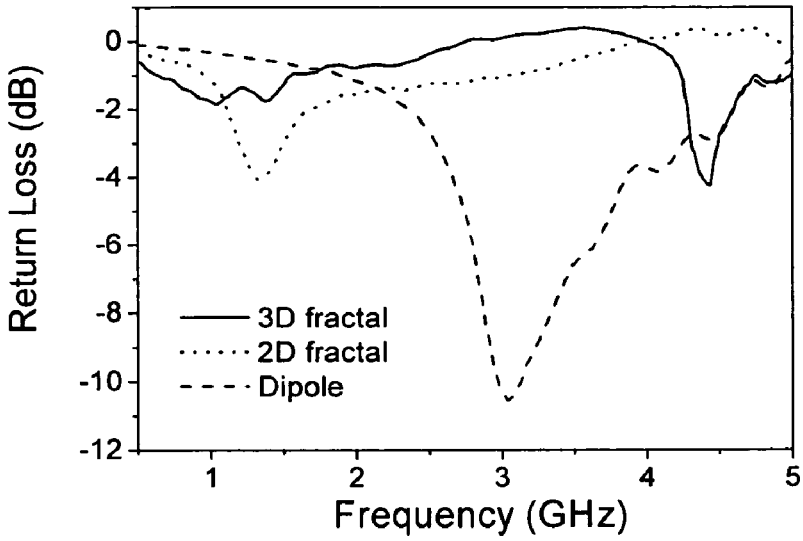
Figure 5:
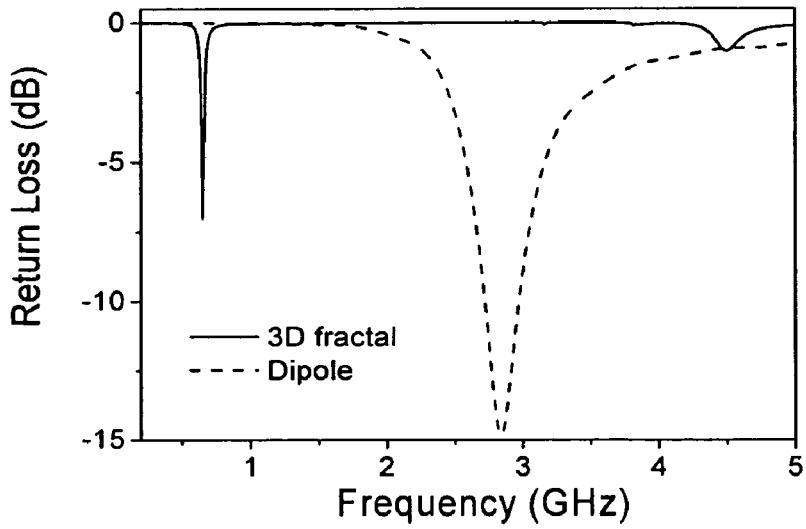

FIG. 5(*a*) shows the radiation characteristics, by measuring the $S_{11}$ parameter, of a 3D fractal with 6 levels (formed as in FIG. 3), 4×4×4 $cm^3$ in size, and for comparison also the characteristics of a 2D 4-level fractal with the same length of 1st-level line as the 3D structure, and a 4.5 cm dipole. These three cases were all center-fed by a coaxial cable of impedance 50Ω. FIG. 5(*b*) shows the simulated results from the finite-difference time-domain method for the 3D fractal and the dipole antennas. When the input impedance is tuned to 5Ω, a significant $S_{11}$ dip is observed, much lower than that of the dipole. This is not seen experimentally in FIG. 5(*a*), where the $S_{11}$ dip at the lowest frequency radiation is very small due to the impedance mismatch. Lower return loss implies high radiation efficiency of the antenna and thus the dips in the return loss should correspond to the radiation frequencies of the antenna. For the dipole antenna the radiation frequency only appears at about 3 GHz, while the 2D and 3D fractal antennas have radiation frequencies at about 1.25 GHz and 0.9 GHz respectively which mean they are capable of radiating EM waves at longer wavelengths. This sub-wavelength radiation (so called because the radiation wavelength is much longer than the antenna dimensions) has the advantage that for a given wavelength a smaller antenna can be used.

Figure 6:
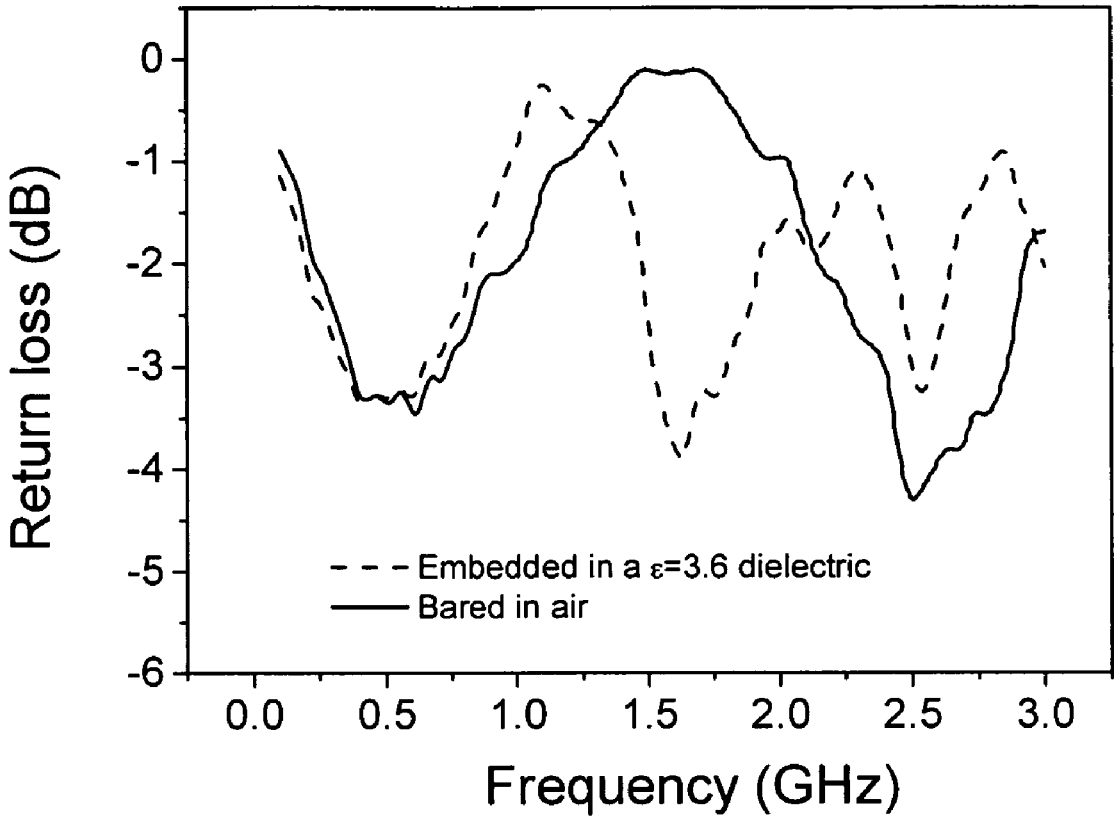
FIG. 6 shows the return loss ($S_{11}$) of a 3D 6-level fractal and one embedded in the dielectric of $\epsilon$=3.6.

FIG. 6 shows the return loss ($S_{11}$) of a 3D 6-level fractal bared in air and one embedded in the dielectric of $\epsilon$=3.6. Radiation frequencies can be tuned by using different dielectrics since embedding the fractal structure in a dielectric material would shift the resonant radiation to a lower frequency (in the example of FIG. 6 the dip at 2.5 GHz gets downshifted to about 1.5 GHz). The lowest radiation band around 0.5 GHz is also shifted somewhat. It is expected that with a larger dielectric constant material, the lowest frequency radiation peak can be moved downward and become very sharp when impedance matched.

Figure 7:
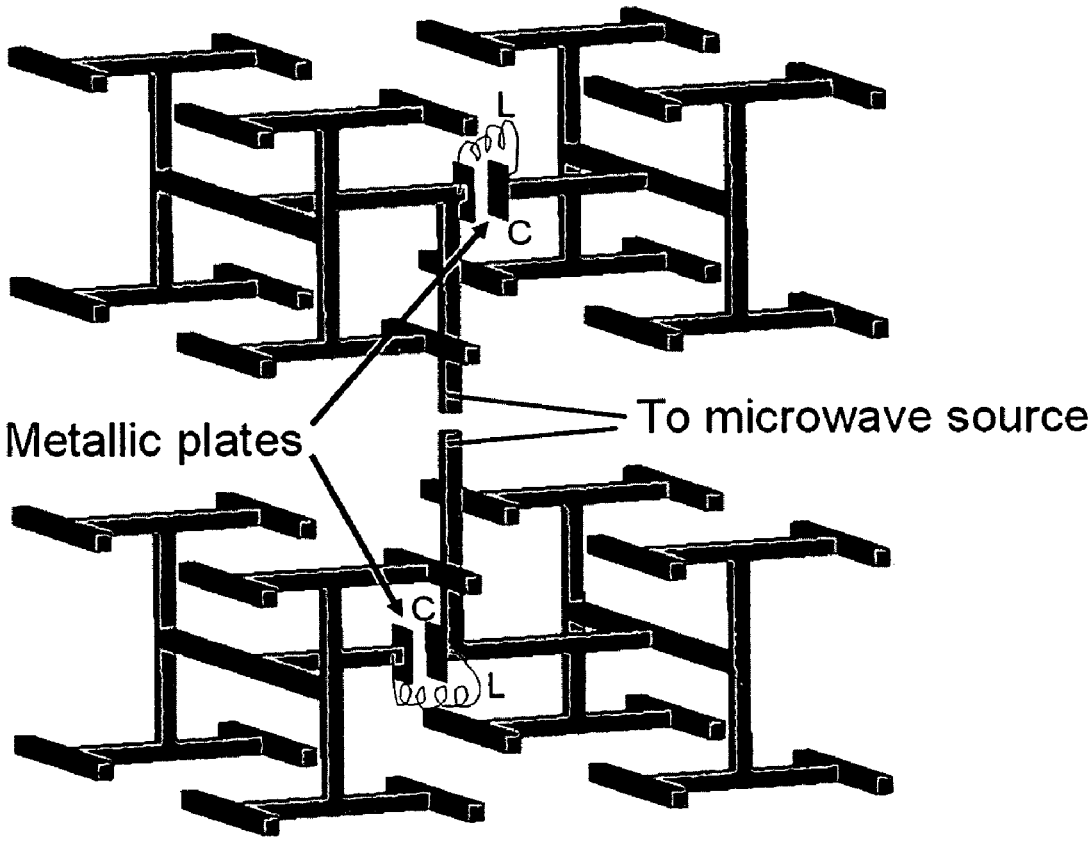
FIG. 7 shows how capacitive/inductive elements can be introduced into the fractal structure.
Figure 8:
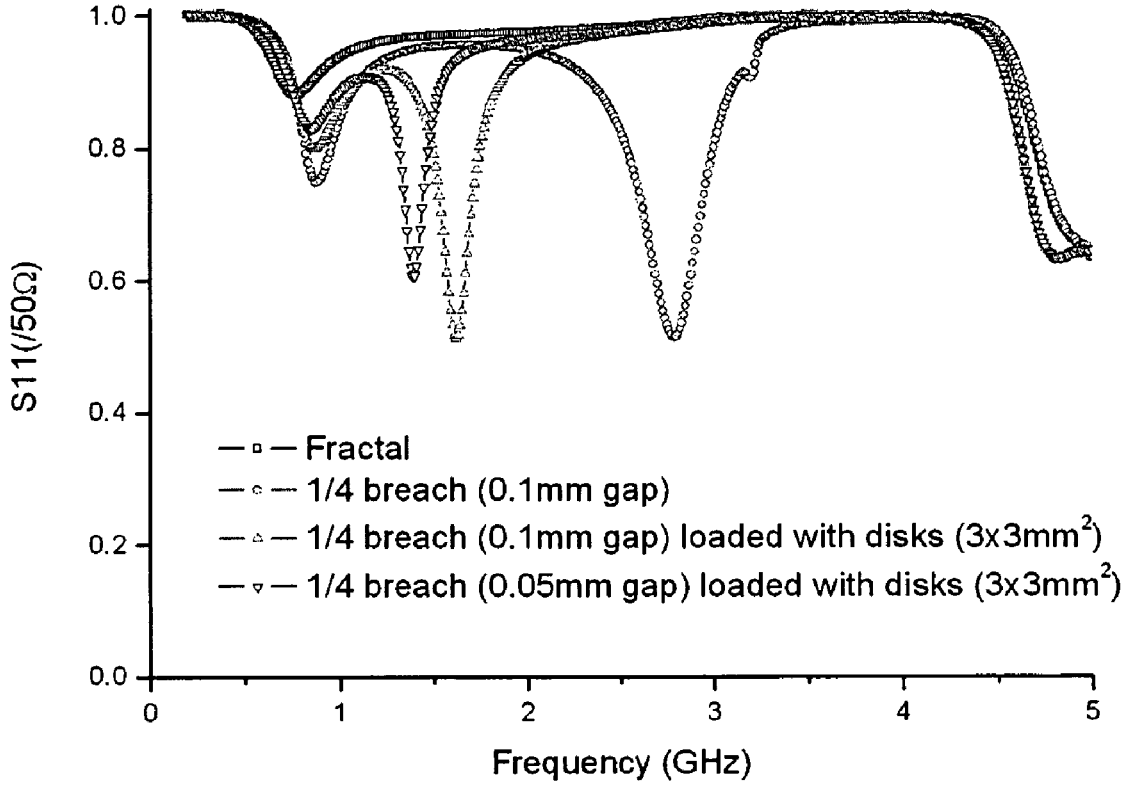
FIG. 8 shows the effect on the emitting frequency of introducing different capacitive elements.

It is also possible to include capacitive or inductive elements into the fractal structure in order to modify the electrical properties. FIG. 7 shows an example of how capacitive and/or inductive elements may be introduced. As can be seen in FIG. 7 the fractal structure is broken at two locations and metal plates are fixed to the broken ends of the fractal structure. Thus two pairs of opposed metal plates are provided which in essence form two capacitors. An inductance may also be connected. The effect of the capacitors is to change the phase of the currents flowing through the cut branches. In this way the emitting frequency can be shifted to lower frequencies and efficiency as can be seen in FIG. 8. FIG. 8 also shows the effect of varying the gap spacing between the plates and it can be seen that with a decreasing gap width between the plates (ie increasing the capacitance) the second emitting frequency can shift from 5 GHz to 1.2 GHz.

Figure 9:
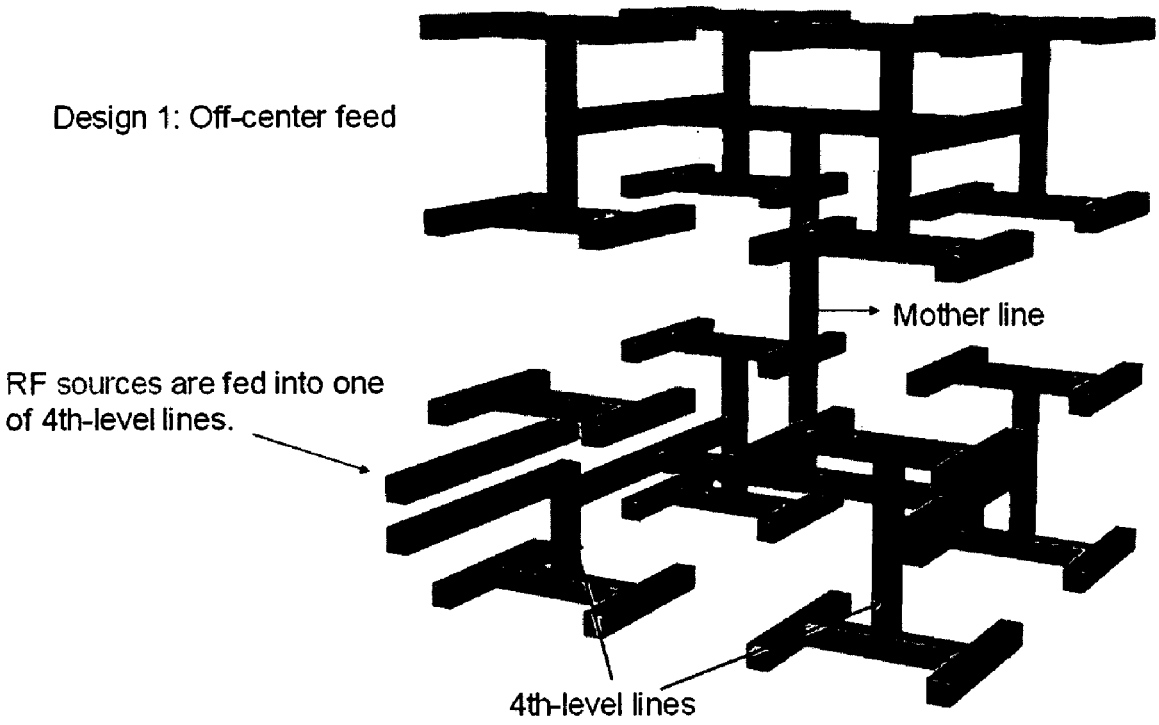
FIG. 9 shows off-center microwave feeding to an antenna.
Figure 10:
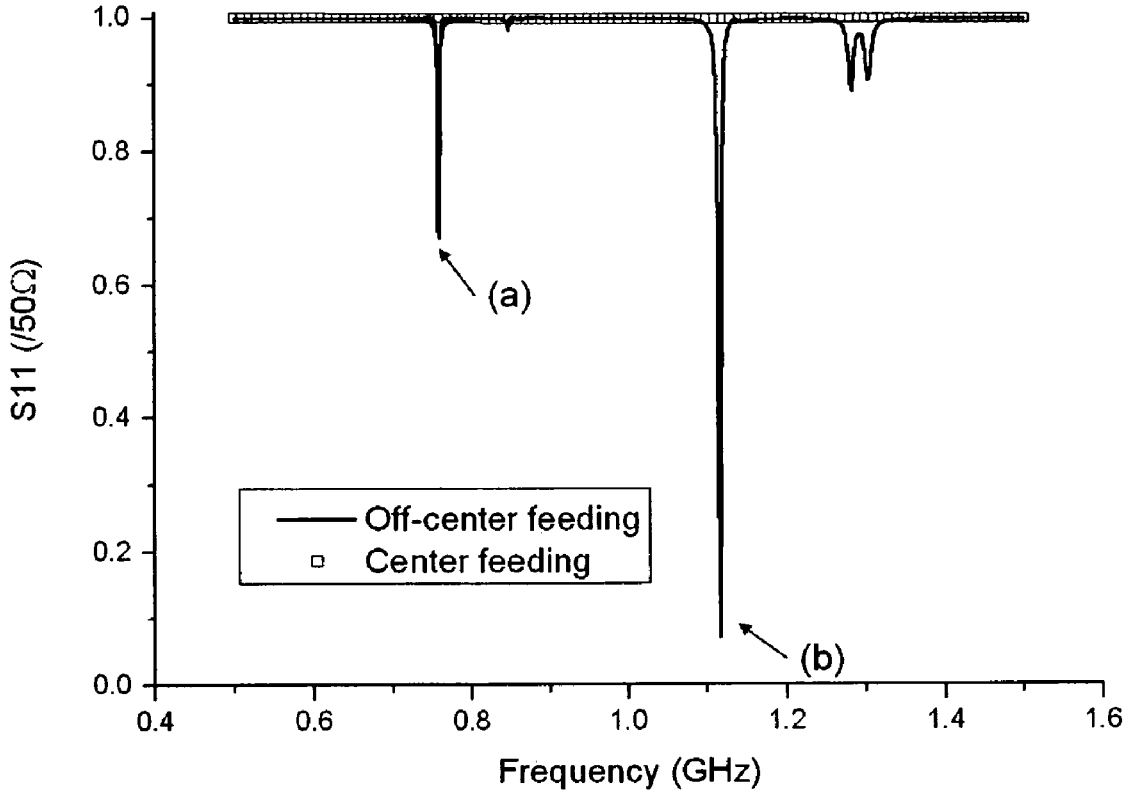
FIG. 10 shows the difference between off-center and center-feeding.

FIGS. 9 and 10 illustrate the importance of the location of the microwave feed for the impedance matching between the source and the antenna. In FIG. 10 it can be seen that if the feed is located at the center of the antenna there is almost no radiation from the antenna, but if the feed is provided off-center (as shown in FIG. 9 where the RF source is fed to one of the $4^{th}$ level lines) radiation occurs at 0.75 GHz and 1.1 GHz.

The invention claimed is:

1. A three-dimensional (3D) bandgap material comprising a three-dimensional fractal structure, tuned to define at least one predetermined transmission bandgap, wherein the fractal structure is formed by subjecting a mother element to a repeated affine transformation through the whole three dimensions, with the rule that each line segment be perpendicular to the plane formed by the two lower-level lines.

2. A bandgap material as claimed in claim 1 wherein said fractal structure is formed of a conductive material.

3. A bandgap material as claimed in claim 2 wherein said conductive fractal structure is embedded in a dielectric material.

4. A bandgap material as claimed in claim 1 wherein said fractal structure is formed by a dielectric material embedded in a conductive material.

5. A bandgap material as claimed in claim 1 wherein the fractal structure is formed with between 2 to 15 levels.

6. A bandgap material as claimed in claim 1 wherein the low-frequency limit of the bandgap(s) possessed by the material is determined by the number of levels of said fractal pattern or the length of lowest-level line.

7. A bandgap material as claimed in claim 1 comprising a conducting three-dimensional H-fractal pattern formed with at least one bandgap at a wavelength that is larger than all the dimensions of the said material.

8. A bandgap material as claimed in claim 1 wherein said fractal structure is defined by dielectric materials forming a 3D H-fractal pattern embedded in a conducting material which has at least one bandgap at a wavelength that is larger than all the dimensions of the said material.

9. A bandgap material as claimed in claim 1 wherein said fractal structure is conductive and further comprising means for injecting current into said fractal structure.

10. A bandgap material as claimed in claim 1 further comprising at least one capacitive or inductive element in said fractal structure.

11. A three-dimensional (3D) bandgap material comprising a three-dimensional fractal structure, tuned to define at least one predetermined transmission bandgap, wherein the fractal structure is formed by subjecting a mother element to a repeated affine transformation through the whole three dimensions, with the rule that each line segment be perpendicular to the plane formed by the two lower-level lines, and wherein said mother element is an H-shape and said transformation comprises scaling.

12. A method of forming a bandgap composite material comprising the step of forming a 3D H-fractal structure with a mother element whose dimensions and number of levels are selected to define at least one predetermined bandgap for said composite material.

13. A method of forming a bandgap composite material as claimed in claim 12 wherein said fractal structure is formed of conductive material and further comprising providing the means for injecting a current into said fractal structure to thereby alter the electromagnetic properties of said composite material.

14. A three-dimensional fractal antenna comprising a three-dimensional conductive fractal structure, wherein the fractal structure is formed by subjecting a mother element to a repeated affine transformation through the whole three dimensions, with the rule that each line segment be perpendicular to the plane formed by the two lower-level lines.

15. An antenna as claimed in claim 14 wherein said fractal structure is formed of a metal.

16. An antenna as claimed in claim 15 wherein said fractal structure is embedded in a dielectric material.

17. An antenna as claimed in claim 14 wherein the fractal structure is formed with between 2 to 15 levels.

18. An antenna as claimed in claim 14 further comprising means for injecting a current to form a 3D radiating antenna with a radiated wavelength larger than all the linear dimensions of the antenna.

19. An antenna as claimed in claim 14 further comprising a capacitive or inductive element in said fractal structure.

20. A three-dimensional fractal antenna comprising a three-dimensional conductive fractal structure, wherein the fractal structure is formed by subjecting a mother element to a repeated affine transformation through the whole three dimensions, with the rule that each line segment be perpendicular to the plane formed by the two lower-level lines, and wherein said mother element is an H-shape and said transformation comprises scaling.

21. A three-dimensional (3D) bandgap material comprising:

a three-dimensional fractal structure, tuned to define at least one predetermined transmission bandgap; and a conducting three-dimensional H-fractal pattern formed with at least one bandgap at a wavelength that is larger than all the dimensions of the said material.

22. A three-dimensional (3D) bandgap material comprising:

a three-dimensional fractal structure, tuned to define at least one predetermined transmission bandgap, wherein said fractal structure is defined by dielectric materials forming a 3D H-fractal pattern embedded in a conducting material which has at least one bandgap at a wavelength that is larger than all the dimensions of the said material.

* * * * *